US005857452A

United States Patent [19]

Troncoso

[11] Patent Number: 5,857,452

[45] Date of Patent: Jan. 12, 1999

[54] ARCHERY BOWSTRING RELEASE DEVICE ASSEMBLY

[76] Inventor: Robert Troncoso, 14090-6100 Rd., Montrose, Colo. 81401

[21] Appl. No.: 16,992

[22] Filed: Feb. 2, 1998

[51] Int. Cl.[6] ..... F41B 5/18

[52] U.S. Cl. ..... 124/35.2

[58] Field of Search ..... 124/35.2

[56] References Cited

U.S. PATENT DOCUMENTS

| | | | |
|---|---|---|---|
| 5,020,508 | 6/1991 | Greene | 124/35.2 |
| 5,261,581 | 11/1993 | Harden | 124/35.2 X |
| 5,323,754 | 6/1994 | Pittman et al. | 124/35.2 |
| 5,595,167 | 1/1997 | Scott | 124/35.2 |
| 5,615,662 | 4/1997 | Tentler et al. | 124/35.2 |
| 5,653,214 | 8/1997 | Lynn | 124/35.2 |

*Primary Examiner*—John A. Ricci
*Attorney, Agent, or Firm*—Donald E. Nist

[57] ABSTRACT

The improved arhery bowstring release device assembly of the present invention includes an archery bowstring release device having a front end with a bowstring engager, a front portion having a component adapted to manually move the bowstring engager between a bowstring retaining position and a bowstring releasing position, an elongated shaft extending rearwardly from the front portion and a detent connected to the rear end of the shaft. The assembly also includes a wrist strap having on its outer surface a sleeve defining a longitudinal passageway therethrough through which the shaft slideably extends. The passageway is of smaller diameter than that of the detent so that the shaft cannot be removed from the sleeve. The release device can be moved into a wrist storage position by sliding the shaft rearwardly in the sleeve, and can be extended forwardly by the shaft to an operative position for use. In a preferred embodiment the bowstring engager consists of a pair of opposed jaws moveable between the closed and open positions by a lever geared thereto and extending outwardly from the front portion of the release device for operation by an archer's finger.

5 Claims, 3 Drawing Sheets

FIG. 1
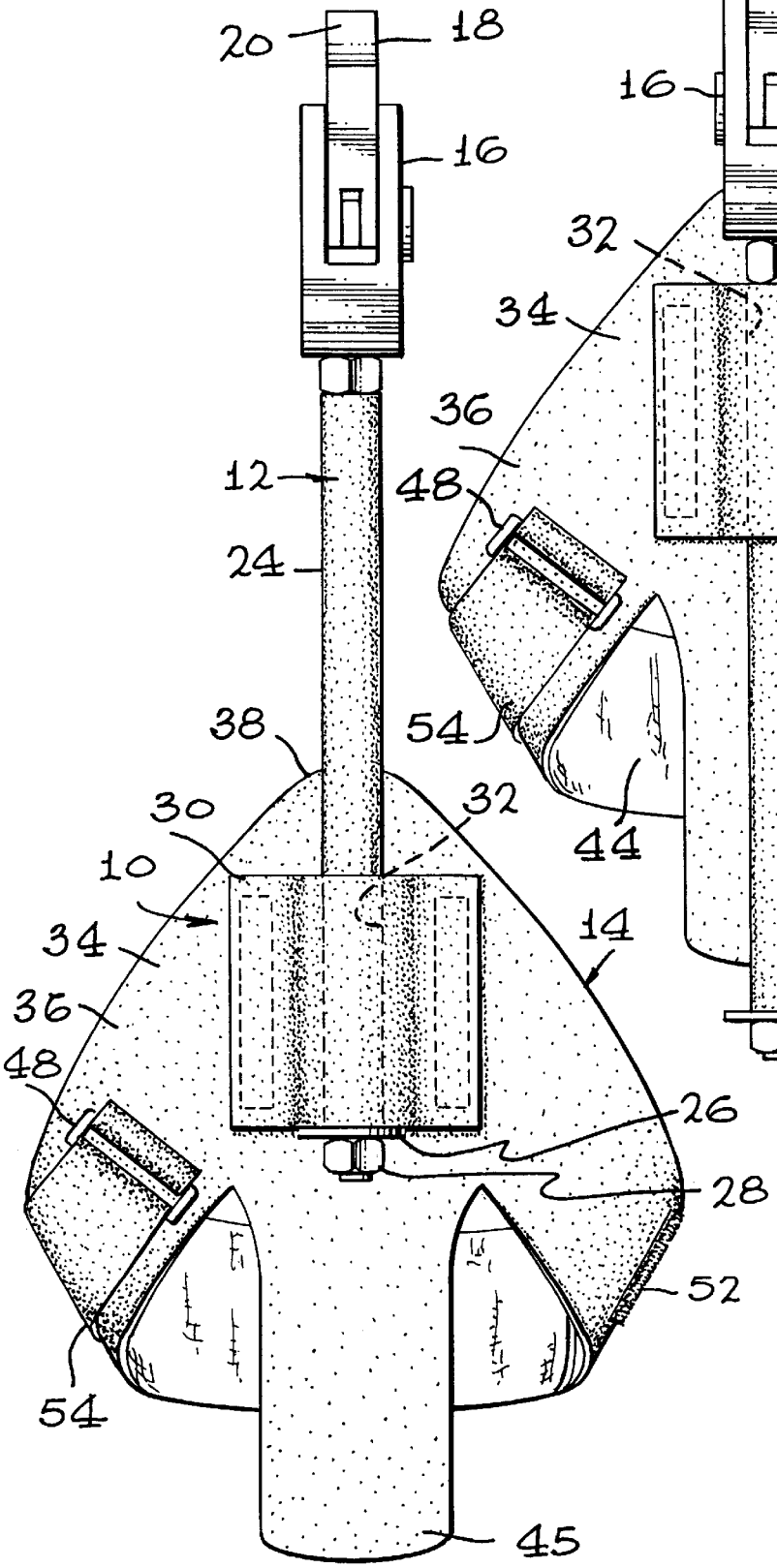
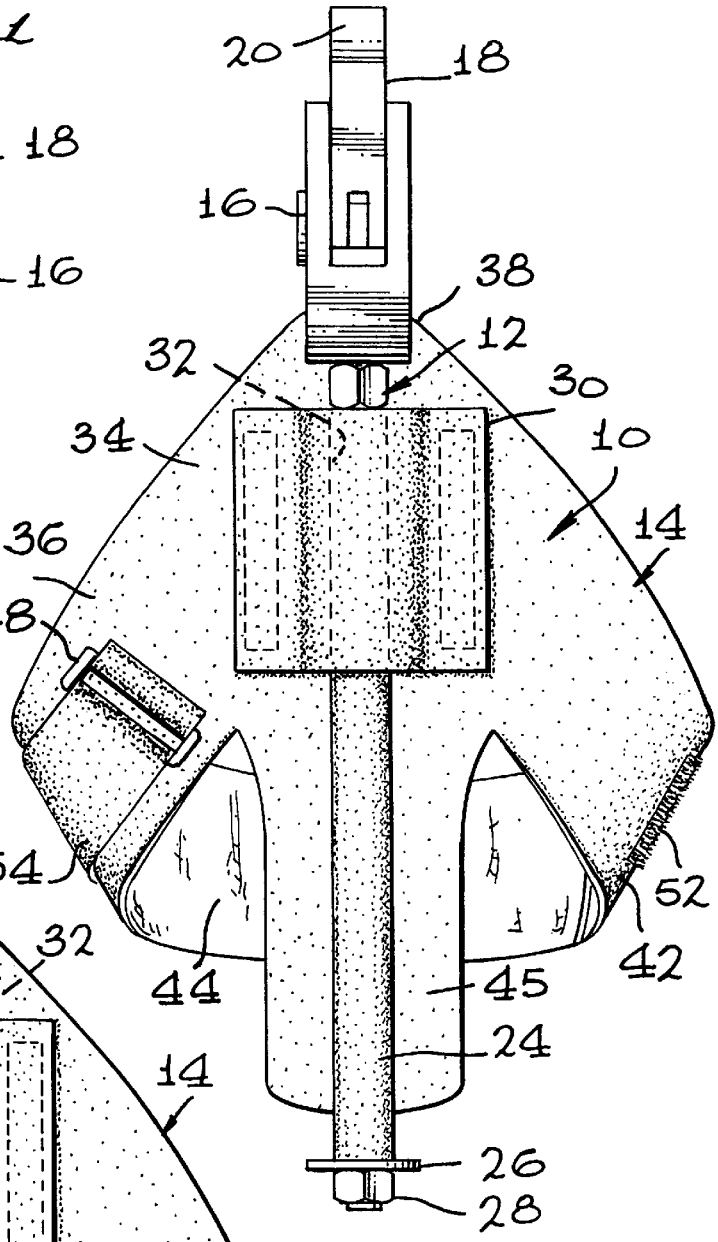
FIG. 2

ARCHERY BOWSTRING RELEASE DEVICE ASSEMBLY

BACKGROUND OF THE INVENTION

1. Field of the Invention

The present invention generally relates to sports equipment and more particularly to an improved assembly combining an archery bowstring release device with a wrist strap.

2. Prior Art

Various types of archery bowstring release devices have been devised, sold and used in the past. Almost all such devices must be held in the archer's hand when the devices are operated. In hunting game it is desireable to have the release device ready to be used. This entails carrying the device in the hand or having it in a pouch or the like from which it must be extracted and then gripped in order to use it. This latter procedure wastes valuable time when time may mean the difference between a game kill and a missed opportunity. If the release device is carried in the hand, however, it interferes with convenient carrying of the archery bow and other equipment and may become entangled with field or forest cover, and seriously impede an archer who is climbing a tree to a tree stand.

There remains a need for an improved archery bowstring release device assembly which enables the archer to carry the release device ready for use, but which avoids the foregoing difficulties as well as providing means of protecting the release device from damage, either to itself or to other equipment of the archer. Such assembly should be simple, inexpensive, durable and efficient and should be easy to use and to maintain.

SUMMARY OF THE PRESENT INVENTION

The improved archery bowstring release device assembly of the present invention satisfies all the foregoing needs. Thus, the assembly enables the archer to carry the release device ready for use but safely stored, preventing damage to the device and other archery equipment, all without in any way impeding the archer's ability to drive a vehicle, climb a tree, carry other equipment and pass through field and forest cover.

The improved assembly of the present invention comprises, in combination, an archery bowstring release device and a wrist strap. The strap is of novel construction, in that it includes on the outer surface thereof a passageway in a sleeve through which the elongated shaft of the release device slideably extends for movement between a rear storage position over the archer's wrist and a forward operative position in which the bowstring-engaging portion of the release device projects to a position in which it can be operated by a finger of the archer to engage and disengage the bowstring for shooting of the bow.

The wrist strap preferably includes portions with hooks and mating portions with loops for quick and easy strapping the assembly to the archer's wrist and removing it therefrom. The rear end of the elongated shaft of the release device includes a detent to prevent the device from separating from the wrist strap.

In a preferred embodiment the bowstring-engaging means comprises a pair of opposable jaws at or adjacent to the front end of the device, which jaws are moveable between a jaws-closed bowstring engaging position and a jaws-open bowstring release position. A lever is geared to the jaws to allow an archer to move the jaws between these two positions by moving the lever with a finger. The lever extends outwardly from the front portion of the device.

The wrist band enables the archer to draw back the bowstring with the release device without having to hand grip and exert force on the releease device itself, possibly torquing it. Instead, the forearm is drawn back with the wrist in a fixed in-line position so that the bowstring reaches full draw with the arm in proper alignment for better shooting technique and greater shooting accuracy. Only the archer's finger need touch the releease device at all, and that only to operate the lever.

Various other features of the improved archery bowstring release device assembly of the present invention are set forth in the following detailed description and accompanying drawings.

DRAWINGS OF A PREFERRED EMBODIMENT OF THE INVENTION

FIG. 1 is a schematic side elevation of the outer side of a preferred embodiment of the improved archery bowstring release device assembly of the present invention, shown with the release device portion of the assembly in the fully extended operative position;

FIG. 2 is a schematic side elevation of the outer side of the assembly of FIG. 1, shown with the release device portion thereof in the retracted storage position in the wrist strap portion of the assembly;

DETAILED DESCRIPTION OF THE PREFERRED EMBODIMENT OF THE INVENTION

FIGS. 1–7 of the drawings:

Now referring more particularly to FIGS. 1 through 7 of the drawings, a preferred embodiment of improved archery bowstring release device assembly of the present invention is schematicly set forth therein.

Figure 3:
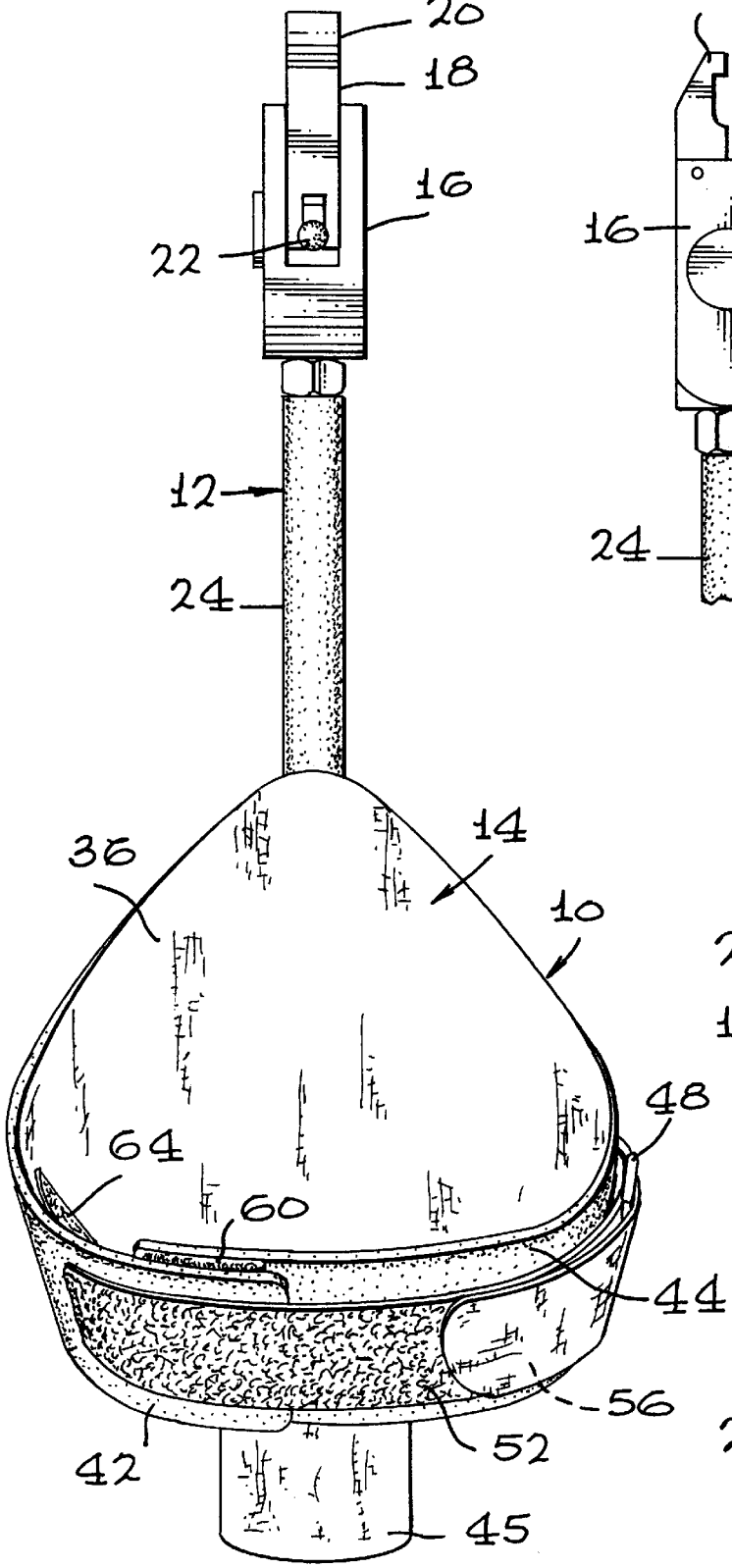
FIG. 3 is a schematic side elevation of the inner side of the assembly of FIG. 1, shown with the release device portion thereof in the fully extended operative position.
Figure 6:
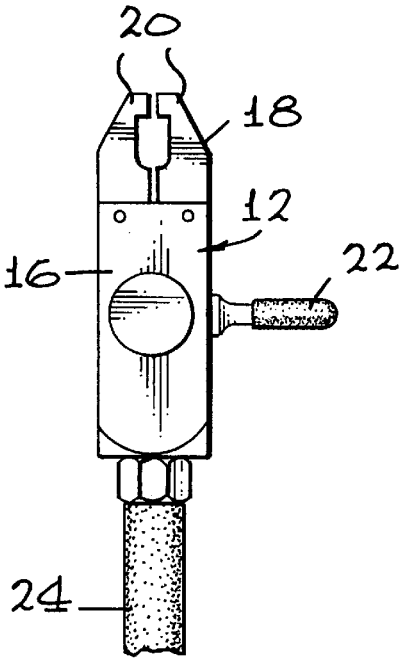
FIG. 6 is a schematic top plan view of the front portion of the release device of FIG. 1, shown with the jaws thereof in the closed bowstring-retaining position; and, FIG. 7 is a schematic top plan view of the front portion of the release device of FIG. 1, shown with the jaws thereof in the open bowstring-releasing position.
Figure 7:
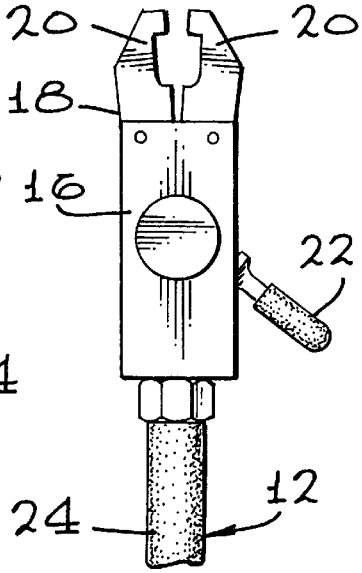

Thus, assembly 10 is shown which comprises a archery bowstring release device 12 slidably connected to a wrist band 14. Release device 12 comprises a front portion 16 having bowstring-engaging means at the front end 18 thereof, such means preferably comprising a pair of opposable jaws 20 moveable between the closed bowstring retaining position shown in FIG. 6 and the bowstring releasing position shown in FIG. 7 by means of a finger operated lever 22 geared to jaws 20 and extending outwardly from front portion 16. Lever 22 is shown in FIGS. 3, 6 and 7.

To the rear end of front portion 16 is connected, preferably integrally, an elongated preferably cylindrical shaft 24, running rearwardly of front portion 16 and terminating in a rear end detent 26 of larger diameter than the diameter of shaft 24 and secured thereto by a nut 28.

Figure 4:
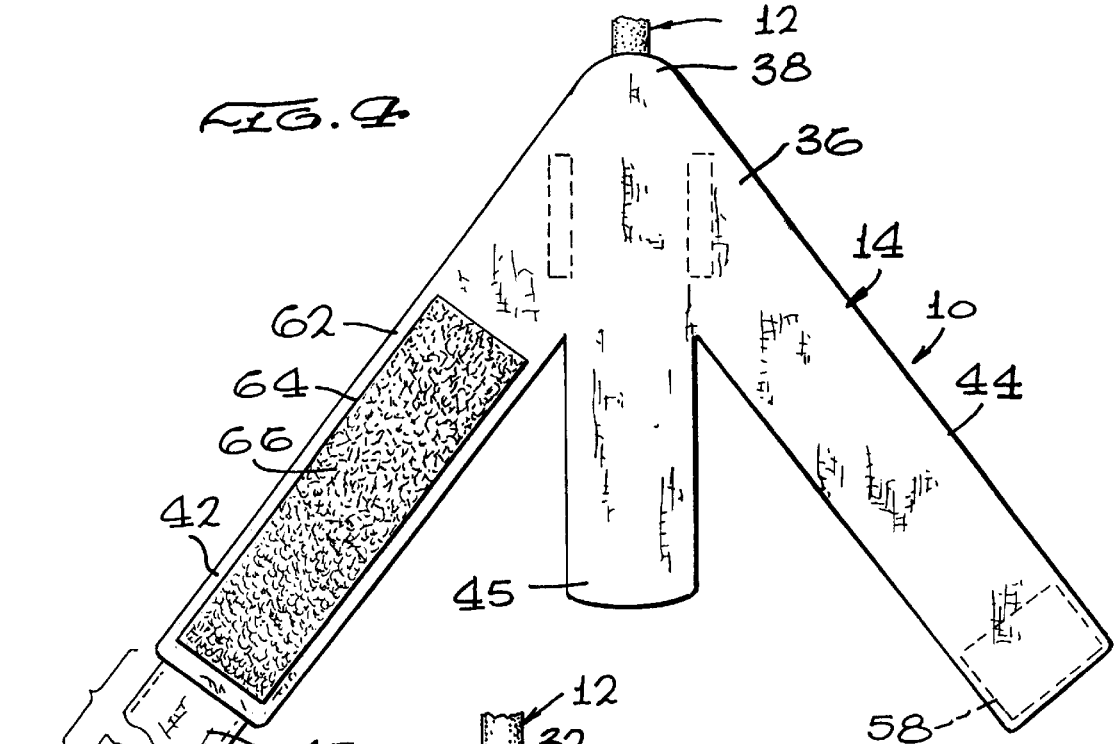
FIG. 4 is a schematic side elevation of the inner side of the wrist strap portion of the assembly of FIG. 1.
Figure 5:
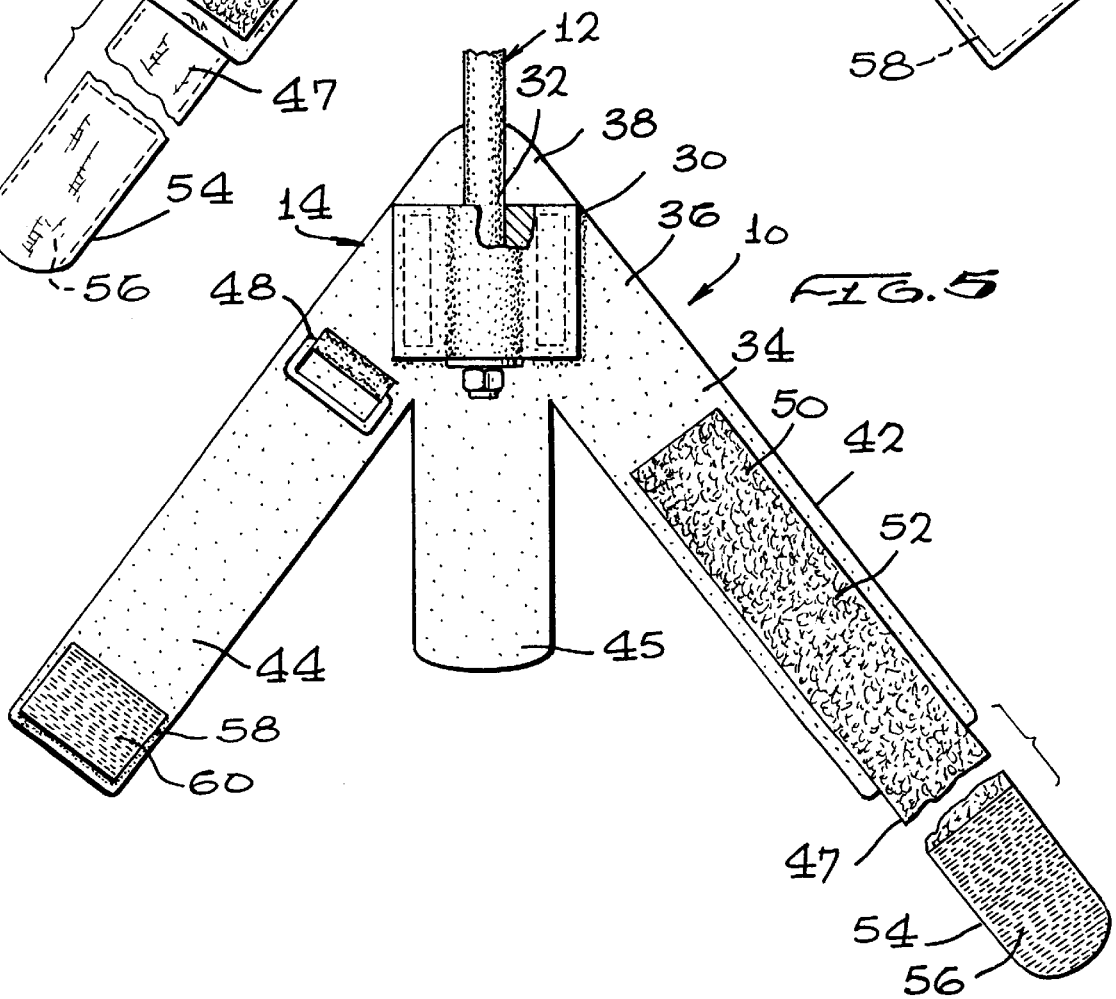
FIG. 5 is a schematic side elevation of the outer side of the wrist strap of FIG. 4.

In assembly 10 shaft 24 slideably passes through a sleeve 30 having a longitudinal passageway 32 therein which also is of smaller diameter than detent 26 so that shaft 24 cannot be detached from wrist band 14. Sleeve 30 is secured to the outer surface 34 of wrist band 14. Wrist band 14 comprises a strap 36 which in the flattened position shown in FIGS. 4 and 5 is generally in the shape of an arrowhead, having a pointed front end 38 and rearwardly and laterally projecting wings 42 and 44, with a wrist-protecting brace 45 along the centerlne of strap 36 adjacent the rear end thereof. Wrist band 14 is shown in FIGS. 1, 2 and 3 in the position it assumes when wrapped around an archer's wrist.

Strap 36 has an elongated flat strip 47 connected to the rear end of wing 42 and a cinch ring 48 connected to outer surface 34 (FIG. 5) of wing 44. Sleeve 30 is disposed adjacent the front end of wrist band 14 with passageway 32 aligned along the longitudinal centerline of strap 36. Strip 47 may have an area 50 on the outer surface thereof covered with hook-receiving loops 52 while the end portion 54 of the outer surface of strip 47 may be covered with loop-engaging hooks 56 to facilitate cinching up strip 47 to hold strap 36 in place around an archer's wrist, as shown in FIGS. 1–3. Wing 44 at the rear end thereof on the outer surface thereof may have an area 58 containing loop-engaging hooks 60 while the inner surface 62 of wing 42 may have an area 64 containing hook-receiving loops 66, also to help secure wrist band 14 around an archer's wrist.

When wrist band 14 is properly secured around an archer's wrist, shaft 24 will abut the medial surface of the archer's hand with the outer surface 34 of wrist band 14 extending medially of the archer's hand. In this position, the archer's forefinger can easily reach and operate lever 22 to open and close jaws 20 for bowstring retention and release when device 12 is in the forward position shown in FIG. 1. When device 12 is not in use, it can be slid backward to the retracted storage position of FIG. 2, out of sight and out of way of the archer, an improved function over any known prior art.

It will be understood that device 12 can employ instead of jaws 20 and lever 22 any comparable bowstring engaging and operating components, without departing from the scope of the present invention. Device 12 can be of metal, ceramic, plastic or the like so long as it is durable. Wrist band 14 can be of any suitable durable material such as leather, plastic, cloth or the like. Device 12 and wrist band 14 can be of any suitable size and proportions.

Various other modifications, changes, alterations and additions can be made in the improved assembly of the present invention, its components and parameters. All such modifications, changes, alterations and additions as are within the scope of the appended claims form part of the present invention.

What is claimed is:

1. An improved archery bowstring release device assembly, said assembly comprising, in combination:

a) an archery bowstring release device having a front portion terminating in a front end, an elongated intermediate portion comprising a shaft, and an opposite rear end, said front end including bowstring engaging means moveable between a bowstring retaining position and a bowstring releasing position, said front portion having means for moving said bowstring engaging means between said two positions by an archer's finger, said rear end including detent means; and, b) a wrist strap adapted to releasably fit around an archer's wrist and having an outer surface and an opposite inner surface, said strap having on said outer surface a sleeve having a longitudinal passageway through which said shaft slides and is retained from removal therefrom by said detent means, said shaft being moveable through said sleeve from a forward release device extended operative position and a rearward release device storage position, whereby said assembly can be carried on the wrist of an archer with said release device in said storage position until said release device is to be used, whereupon the archer can extend said release device to the forward operative position for use.

2. The improved archery bowstring release device assembly of claim 1 wherein said bowstring engaging means comprises a pair of opposable jaws moveable between a jaws-closed bowstring retaining position and a jaws-open bowstring relasing position, said front portion of said release device including a lever extending outwardly therefrom and geared to said jaws for manually moving said jaws between said two positions.

3. The improved archery bowstring release device assembly of claim 2 wherein said wrist strap is generally arrow-shaped in configuration and includes an elongated wrist brace disposed along the longitudinal axis of said strap.

4. The improved archery bowstring release device assembly of claim 1 wherein said shaft is tubular and wherein said wrist strap includes a plurality of mating hook portions and loop portions for releasably securing said wrist strap to a wrist.

5. The improved archery bowstring release device assembly of claim 1 wherein said detent means comprises a terminal flange on the rear end of said shaft, which flange is of greater diameter than that of said sleeve passageway.

* * * * *